United States Patent [19]

Sindo

[11] Patent Number: 4,990,966

[45] Date of Patent: Feb. 5, 1991

[54] IMAGE FORMING APPARATUS

[75] Inventor: Yukiti Sindo, Yamato, Japan

[73] Assignee: Ricoh Company, Ltd., Tokyo, Japan

[21] Appl. No.: 443,513

[22] Filed: Nov. 30, 1989

[30] Foreign Application Priority Data

Dec. 1, 1988 [JP] Japan ..... 63-302283

[51] Int. Cl.[5] ..... G03G 21/00

[52] U.S. Cl. ..... 355/321

[58] Field of Search ..... 355/200, 211, 210, 316, 355/321, 326, 300, 309

[56] References Cited

U.S. PATENT DOCUMENTS

| | | | |
|---|---|---|---|
| 4,662,739 | 5/1987 | Sakai et al. | 355/200 X |
| 4,708,455 | 12/1987 | Kubota et al. | 355/211 |
| 4,728,094 | 3/1988 | Yoshida | 355/309 X |
| 4,730,206 | 3/1988 | Sawada et al. | 355/309 |
| 4,827,311 | 5/1989 | Bothner | 355/300 X |

*Primary Examiner*—A. T. Grimley
*Assistant Examiner*—Sandra L. Hoffman
*Attorney, Agent, or Firm*—Oblon, Spivak, McClelland, Maier & Neustadt

[57] ABSTRACT

An image forming apparatus having a photoconductive element for forming a toner image by an electrophotographic process thereon, and transporting a paper sheet to which the toner image has been transferred from the photoconductive element along a paper transport path which extends from a paper feeding section to a paper discharging section via an image transferring section and an image fixing section. Various process units arranged along the paper transport path are divided into a paper feeding section and a transport unit which is located downstream of the paper feeding section and includes a transferring device, a fixing device and a paper transporting device. The paper feeding section is pulled out sideways from the apparatus body in a direction opposite to the direction of paper transport and pushed into the apparatus body in the direction of paper transport. The transport unit is pulled out of the apparatus body frontward perpendicularly to the intended direction of paper transport pushed into the apparatus body in the opposite direction.

9 Claims, 16 Drawing Sheets

IMAGE FORMING APPARATUS

BACKGROUND OF THE INVENTION

The present invention relates to an image forming apparatus of the type transporting a paper sheet to which a visible image or toner image formed by an electrophotographic process is to be transferred from an image carrier or photoconductive element from a paper feeding section to a paper discharging section via an image transferring section and an image fixing section. More particularly, the present invention is concerned with an image forming apparatus which facilitates the removal of a paper sheet which might have jammed in a paper transport path and therefore enhances the efficient maintenance of the device.

In an electrophotographic copier, laser printer, facsimile machine or similar image forming apparatus implemented by an electrophotographic process, a toner image is formed on an image carrier such as a photoconductive element by an electrophotographic process and transferred by a transfer charger to a paper sheet which is fed from a paper feeding section. The paper sheet carrying the toner image thereon is separated from the photoconductive element, then transported to a fixing section for fixing the toner image, and then driven out of the apparatus to a paper discharging section. A paper transport path extending from the paper feeding section to the paper discharging section has not only paper transporting means and guiding means but also a transfer charger, fixing roller and other various process units. Hence, a paper sheet being moved along the transport path is apt to jam it. To facilitate the removal of a jammed sheet, it has been customary to arrange the paper transport path such that the process units can be pulled out of the apparatus body, as needed. Japanese Patent Laid-Open Publication (Kokai) No. 54-88129, for example, discloses an apparatus in which all the units constituting a paper transport path inclusive of a paper feed unit can be pulled out frontward as desired. While this kind of configuration may facilitate the removal of a jammed sheet and maintenance, it critically reduces the mechanical strength of the front end of the apparatus body because a device for pulling out all of the units is provided over the entire width of the front end. The apparatus body, therefore, has to be further increased in dimensions. In addition, the structure of the apparatus body has to be reinforced so as to prepare for the pull-out of the above-mentioned device. Moreover, when it comes to an image forming apparatus having a plurality of paper feeders arranged one upon another, such a prior art scheme does not have much effect on any paper jam which occurs at a lower paper feeder. Japanese Patent Laid-Open Publication No. 57-184943 proposes an apparatus in which a paper transport path extending from a paper feeding section to a paper discharging section is divided into two parts at, for example, a position between a transport belt for transporting a paper sheet from an image transferring section to an image fixing section and an inlet guide of the image fixing section. Process units belonging to one of such two parts and those belong to the other part can be pulled out of the apparatus away from each other in the intended direction of paper transport. With this scheme, however, it is impossible to mount a sorter, finisher or similar optional unit on the side of the apparatus body where the paper discharging section is positioned, for example. This prevents an image forming apparatus from being systematized or being provided with multiple functions.

SUMMARY OF THE INVENTION

It is therefore an object of the present invention to eliminate the problems particular to the paper transport path of prior art image forming apparatuses as discussed above.

It is another object of the present invention to provide an image forming apparatus which facilitates the removal of a jamming paper sheet and promotes the ease of maintenance.

It is another object of the present invention to provide an image forming apparatus which is free from the obstruction to systematization and has sufficient mechanical strength.

It is another object of the present invention to provide a generally improved image forming apparatus.

An image forming apparatus using an electrophotographic process of the present invention comprises an image carrier, paper feeding means provided in a paper feeding section which is located at one of laterally opposite sides of a body of the image forming apparatus, image transferring means provided in an image transferring section for transferring a toner image formed on the image carrier to a paper sheet which is fed from the paper feeding section, image fixing means provided in an image fixing section for fixing the toner image transferred to the paper sheet, paper transporting means for transporting the paper sheet fed from the paper feeding means along a paper transport path which extends to a paper discharging section via the image transferring section and image fixing section, the image transferring means, image fixing means and paper transporting means constituting a transport unit, first guide means extending in a lateral direction in the body for guiding the paper feeding section which is slidable outward in a direction opposite to an intended direction of paper transport and inward in the itended direction of paper transport, and second guide means extending in a longitudinal direction in the body for guiding the transport unit which is slidable inward and outward perpendicularly to the intended direction of paper transport.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
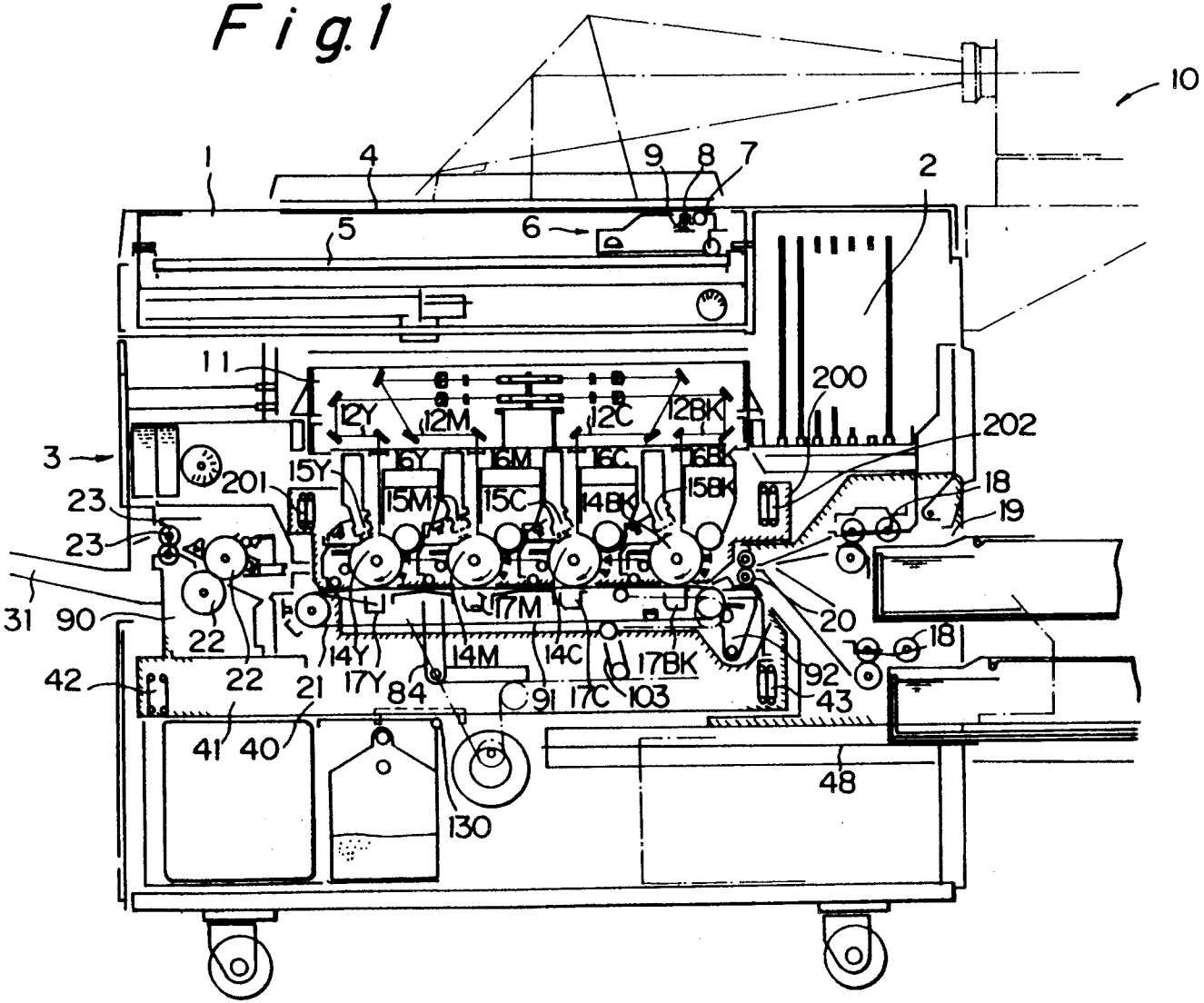
FIG. 1 is a section showing the general construction of an image forming apparatus embodying the present invention.

Referring to FIG. 1 of the drawings, an image forming apparatus embodying the present invention is shown which is implemented as a full-color copier of the type transferring a composite image of color-separated image components to a paper sheet by way of example. In this type of full-color copier, imagewise light components individually representative image data produced by separating a document image into a blue, a green and a red component are read. The intensity levels of the individual imagewise light are converted into image data to be developed in yellow, magenta, cyan and black by arithmetic operations. Laser beams individually modulated by the image data scan their associated photoconductive elements to write the image data. The resulting latent images electrostatically formed on the individual photoconductive elements are developed in yellow, magenta, cyan and black to form toner images. A paper sheet is fed from a paper feeding section to a transfer belt which is rotated to sequentially contact the photoconductive elements, so that the toner images are sequentially transferred one upon another to the paper sheet. The toner images on the paper sheet are fixed to produce a full-color image.

As shown in FIG. 1, the copier has a document reading section 1 and an image processing section 2 which are located above a printing section 3. A glass platen 4 is positioned on the top of the document reading section 1 so that an original document may be laid thereon. A guide rail 5 is located below the glass platen 4 and extends in parallel with and over the entire length of the latter in the right-and-left direction as viewed in the figure. A scanner 6 is mounted on the guide rail 5 and driven by a scanning motor (not shown) to move along the guide rail 5 at a constant speed. The scanner 6 is made up of a light source 7, a converging light conducting array 8, and a 1 magnification color sensor 9 located at the focusing position of the array 8. With this document reading section, it is also possible to lay a screen on the glass platen 4 and read a slide which is projected onto the screen by a slide projector 10.

Image data signals representative of a blue, a green and a red component as read by the color sensor 9 are subjected to arithmetic operations at the image processing section 2. The image processing section 2 transforms the image data signals into image signals which are to be individually developed by toners of three primary colors, i.e., yellow (Y), magenta (M) and cyan (C), and a black (Bk) toner. The image signals are fed to a laser writing unit 11 which is included in the printing section. The laser writing unit 11 has four subunits 12Y, 12M, 12C and 12Bk for individually emitting laser beams each of which has been modulated by respective one of the four different kinds of image data to be developed in Y, M, C and Bk. Laser beams issuing from the subunits 12Y, 12M, 12C and 12Bk are respectively incident to photoconductive drums 14Y, 14M, 14C and 14Bk which are arranged side by side and in parallel to each other. The lowermost points of the drums 14Y to 14Bk are positioned in the same plane.

A charger 15, the above-mentioned laser writing position, a developing unit 16 and a transfer charger 17 are arranged around each of the drums 14Y, 14M, 14C and 14Bk in this sequence with respect to the direction of rotation of the drum which is indicated by an arrow. It is to be noted that the suffixes Y, M, C and Bk correspond to the suffices of the drums 14Y, 14M, 14C and 14Bk, respectively. The developing units 16Y, 16M, 16C and 16Bk each stores a developer of a particular color. A transfer belt 21 is located below and movable toward and away from the drums 14Y, 14M, 14C and 14Bk. A paper feeding section 19 has two paper cassettes each being loaded with a stack of paper sheets of a different size. A paper sheet is fed from one of the cassettes by a feed roller 18 associated with the cassette and a register roller 20 to the transfer belt 21. The transfer belt 21 causes the paper sheet to contact the four drums in sequence and thereby transfers toner images of colors Bk, C, M and Y formed on the associated drums to the paper sheet one upon another. The paper sheet carrying the resulting composite color image thereon is separated from the transfer belt 21, then fixed by a fixing roller 22, and then driven out of the copier to a copy tray 31 by a discharge roller 23. During the transport, the paper sheet is electrostatically adhered to the transfer belt 21 and, therefore, transported with accuracy at the moving speed of the belt 21. The transfer belt 21 may be rotated about a drive roller together with transfer chargers 17Y, 17M, 17C and 17Bk and away from the drums to a position indicated by a dash-and-dot line in the figure. In this position, the transfer belt 21 can be pulled out of and inserted into the copier in a direction perpendicular to the sheet surface of the figure. A cleaning unit 92 is located at the right-hand side of the transfer belt 21 as viewed in the figure for the purpose of removing paper dust, toner particles and other undesirable particles from the belt 21.

The paper feeding mechanism extending from the paper cassettes to the register roller is constructed into a paper feed unit 19. The paper feed unit 19 may be pulled out of the copier to a position indicated by a dash-and-dot line in FIG. 1 on and along slide rails 48 which extend in the right-and-left direction as viewed in the figure. From the dash-and-dot line position, the paper feed unit 19 will be inserted to a predetermined position in the copier. The transfer unit 91 including the transfer chargers 17Y, 17M, 17C and 17Bk and transfer belt 21, the belt cleaning unit 92, and a fixing unit 90 including the discharge roller 23 constitute a transport unit 40 which is mounted on a drawer section 41. The drawer section 41 is in turn mounted on a pair of slide rails 42 and 43 which extend in the front-and-rear direction of the copier, i.e., in the direction perpendicular to the sheet surface of FIG. 1. Hence, the transport unit 40 can be pulled out and pushed into the copier along the slide rails 42 and 43 integrally with the drawer section 41. The drums 14Y, 14M, 14C and 14Bk and various image forming process units arranged therearound constitute an image forming unit 200. The image forming unit 200 can be pulled out of the copier on and along a pair of slide rails 201 and 202 which also extend in the front-and-rear direction of the copier. The slide rails 48 for the sheet feed unit 19 and the slide rails 43 for the transport unit 40 extend crosswise to each other.

Figure 2:
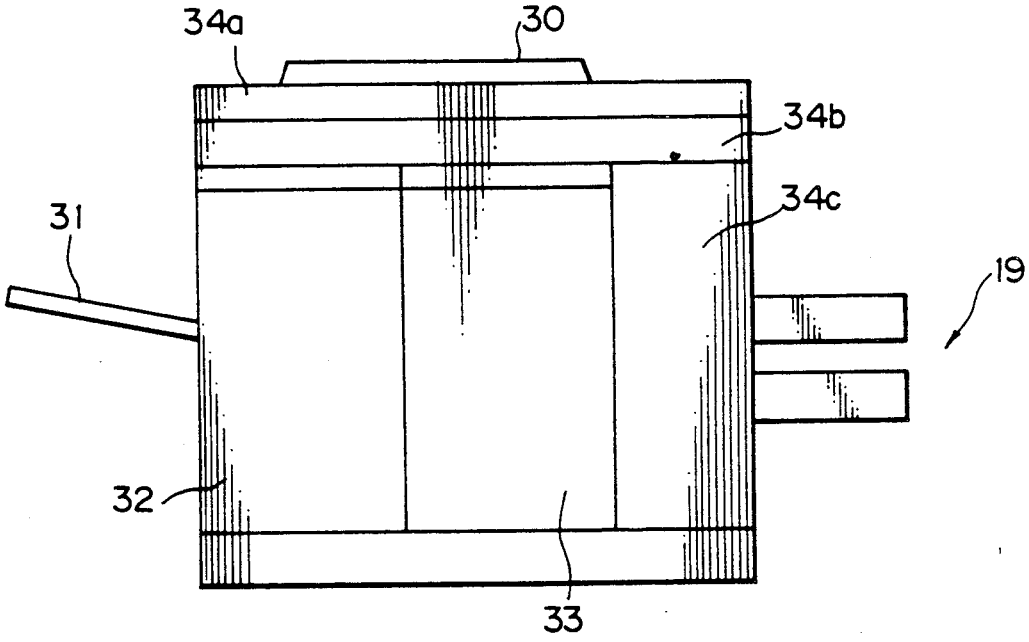
FIG. 2 is an external front view of the apparatus shown in FIG. 1.
Figure 3:
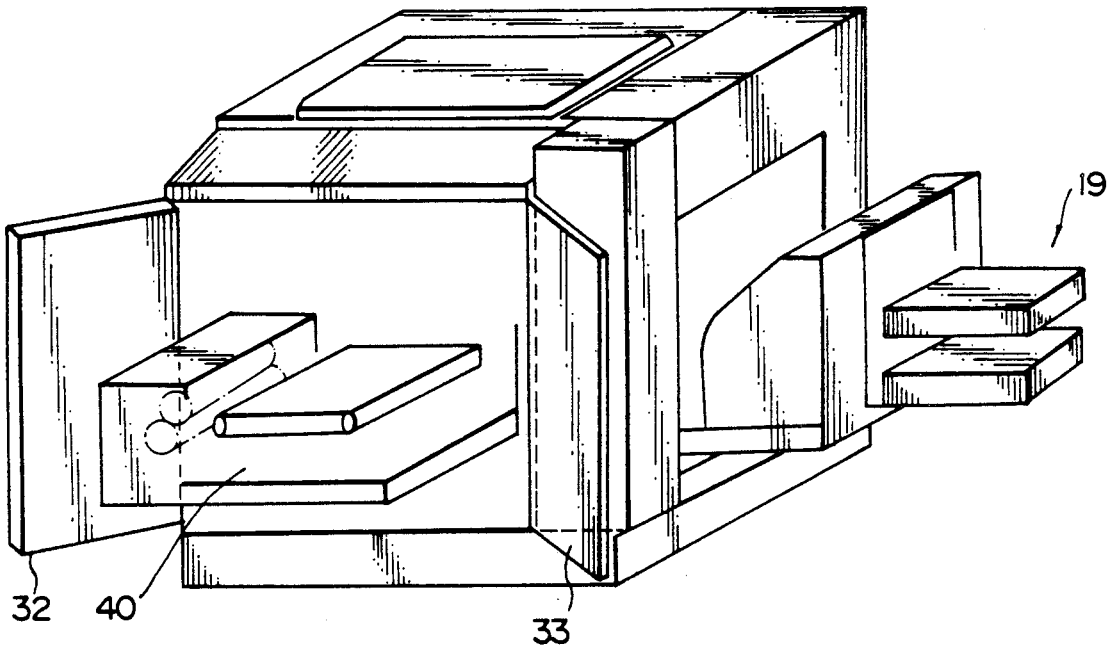
FIG. 3 is a perspective view showing units having been pulled out of the apparatus shown in FIG. 1.

As shown in FIGS. 2 and 3, the copier body has front doors 32 and 33 to allow the transport unit 40 and image forming unit 200 to be pulled out and pushed into the copier body as needed. An opening is formed through a right cover of the copier body for mounting and dismounting the paper feed unit 19. In FIG. 2, there are also shown a cover plate 30 for pressing a document from the above, a cover 34*a* having a control panel, and other covers 34*b* and 34*c*.

The various units and sliding mechanisms mentioned above will be described in detail hereinafter.

Figure 4:
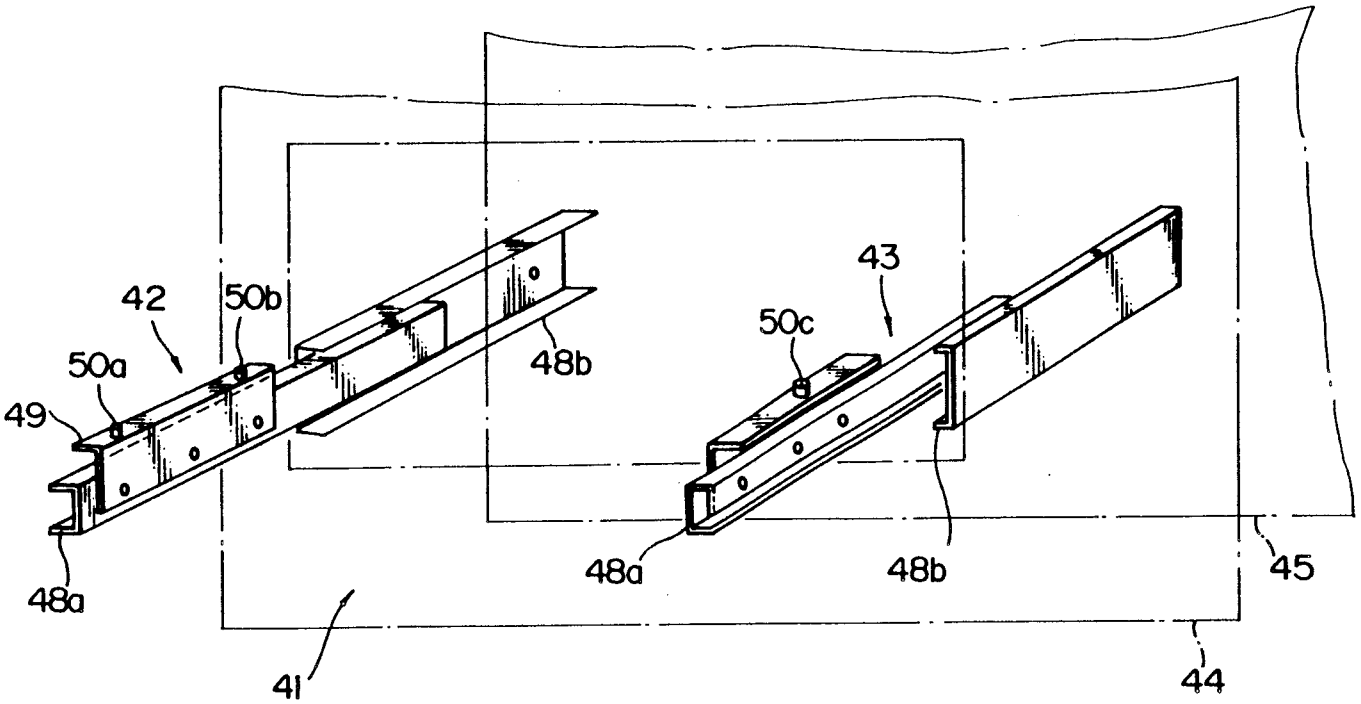
FIG. 4 is a perspective view of a drawer section for pulling out a transport unit.

FIG. 4 is a perspective view showing the drawer section 41 which is loaded with the transport unit 40. As shown, the drawer section 41 is composed of a right sliding section 43 and a left sliding section 42. These sliding sections 42 and 43 are shown in detail in FIGS. 5 and 6, respectively.

Figure 5:
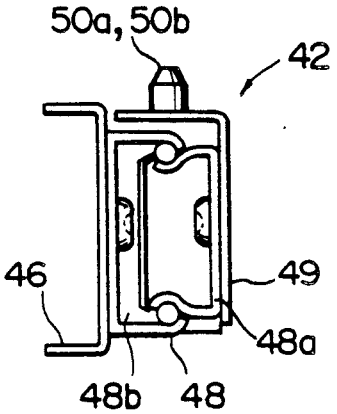
FIGS. 5 and 6 are sections each showing a sliding section located at respective one of opposite sides.
Figure 6:
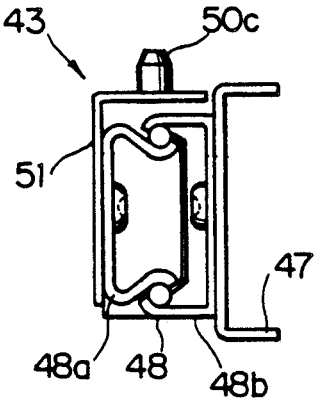

As shown in FIGS. 5 and 6, each slide rail 48 is implemented as a commercially available slide rail of the type having a stationay rail 48*b*, a slidable rail 48*a*, and balls intervening between the stationary and slidable rails 48*b* and 48*a*. As shown in FIG. 4, each of the stationary rails 48*b* is rigidly connected to respective one of stays 46 and 47 which are fixed at opposite ends thereof to a front and a rear panel 44 and 45 of the copier body. Slide guides 49 and 51 are individually fixed to the opposite slide rails 48*a*. Positioning pins 50*a* and 50*b* and a positioning pin 50*c* are studded on the left slide guide 42 and the right slide guide 43, respectively. The transport unit 40 has guide holes 62*a* and 62*b* and a guide hole 63*a* (FIG. 8) which mate with the positioning pins 50*a* and 50*b* and the positioning pin 50*c*, respectively, as will be described.

Figure 7:
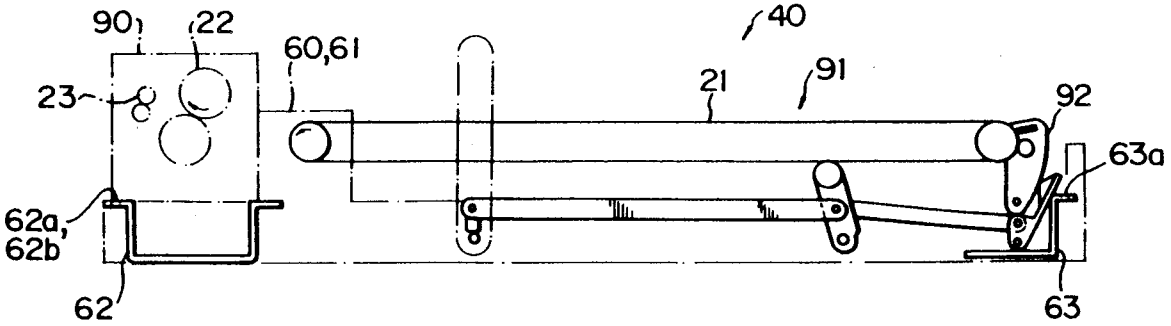
FIG. 7 is a front view of the transport unit.
Figure 8:
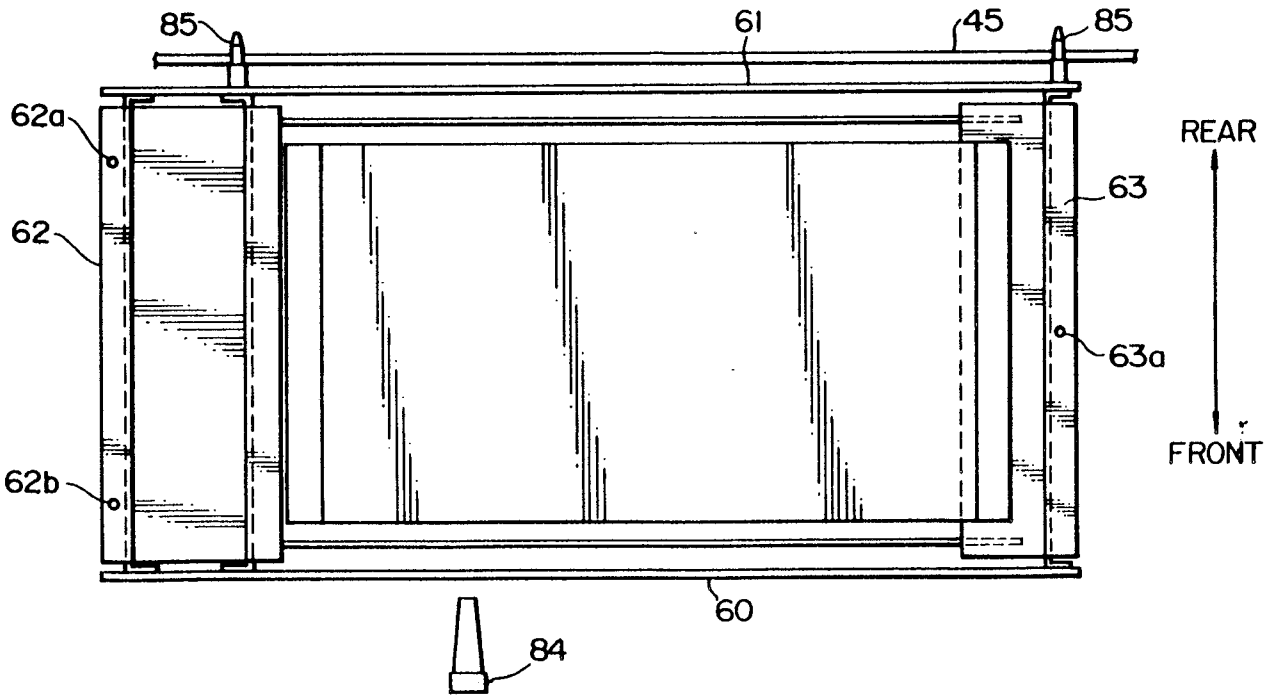
FIG. 8 is a top plan view of the transport unit.

Referring to FIGS. 7 and 8, the transport unit 40 has a front wall 60 and a rear wall 61, and a right and a left support member 63 and 62 each being securely connected to the front and rear walls 60 and 61 at opposite ends thereof. The support members 62 and 63 are formed with the guide holes 62*a* and 62*b* and the guide hole 63*a*, respectively. When the guide pins 50*a*, 50*b* and 50*c* are respectively received in the guide holes 62*a*, 62*b* and 63*a*, the entire transport unit 40 is mounted on the drawer section 41 and movable into and out of the copier body inegrally with the latter and perpendicularly to the direction of paper transport.

Figure 9:
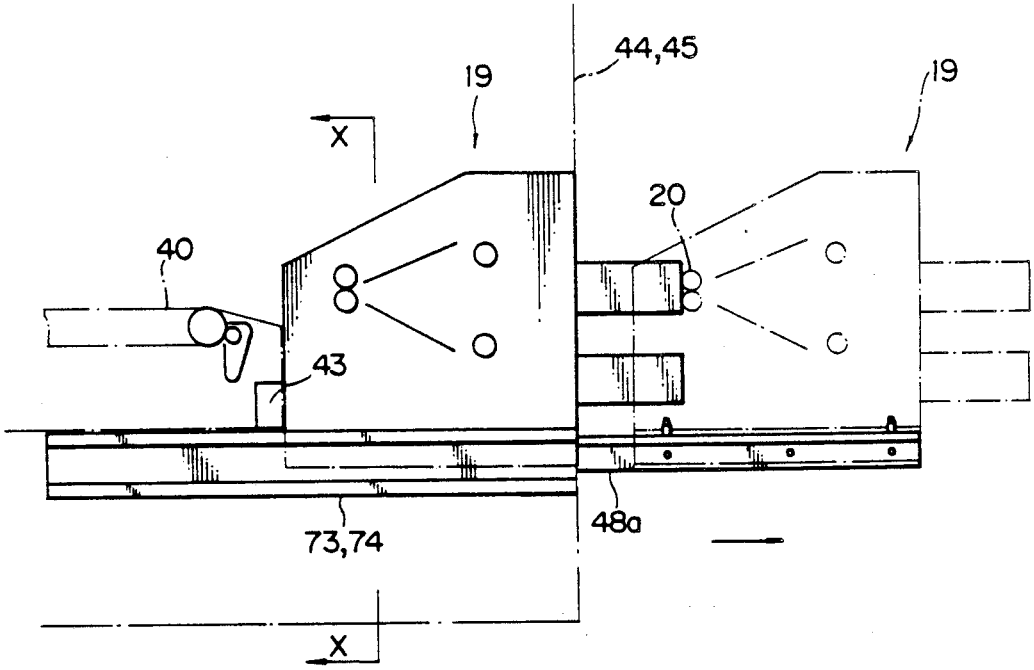
FIG. 9 is a front view of a paper feed unit.
Figure 10:
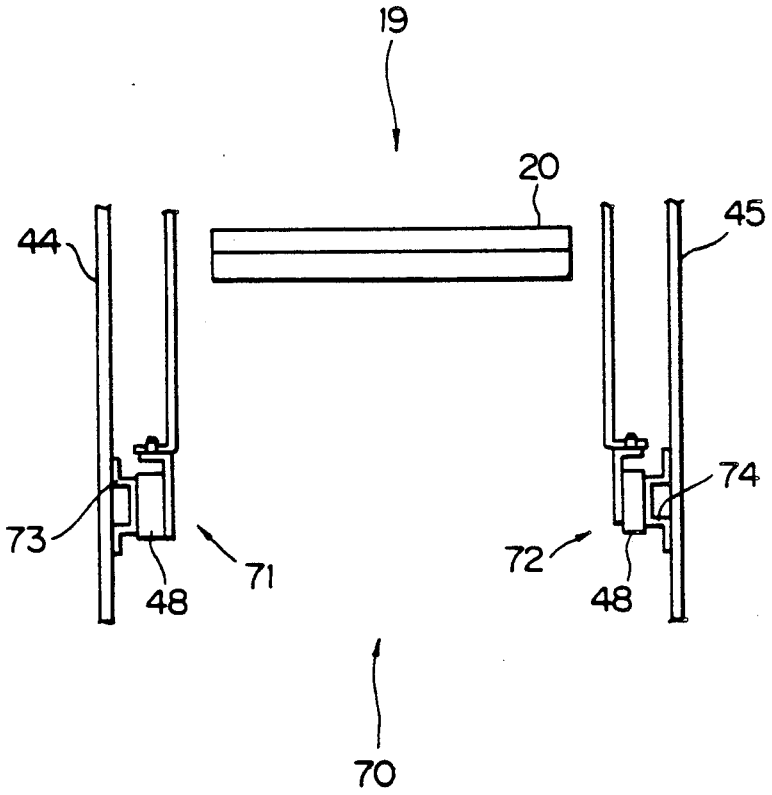
FIG. 10 is a section of the paper feed unit.

Referring to FIGS. 9 and 10, a drawer section 70 associated with the sheet feed unit 19 is shown. While the sliding sections 42 and 43 of the drawer 41 associated with the transport unit 40 are respectively mounted on the stays 46 and 47 which extend between the front and rear panels 44 and 45 of the copier body, the drawer 70 has sliding sections 71 and 72 which are directly mounted on the opposite panels 44 and 45, respectively. Guide holes of the paper feed unit 19 are individually mated with positioning pins which are studded on the upper ends of the sliding sections 71 and 72, whereby the paper feed unit 19 is mounted on the drawer section 70. As shown in FIG. 9, the paper feed unit 19 is movable into and out of the copier body integrally with the drawer section 70 in the right-and-left direction as viewed in the figure. The front sliding section 71 comprises a slide rail 48 which is rigidly mounted on the front panel 44 by a bracket 73, while the rear sliding section 72 comprises a slide rail 48 rigidly mounted on the rear panel 45 by a bracket 74. It is noteworthy that the sliding sections of the drawer 41 of the transport unit 40 and those of the drawer 70 of the paper feed unit 19 extend crosswise to each other at at least one location. These sliding sections, therefore, form a three-dimensional framework in cooperation with the stays 47, brackets 73 and 74 and various covers. Such a framework is successful in reinforcing the covers of the copier body which are provided with large openings as stated earlier.

Figure 11:
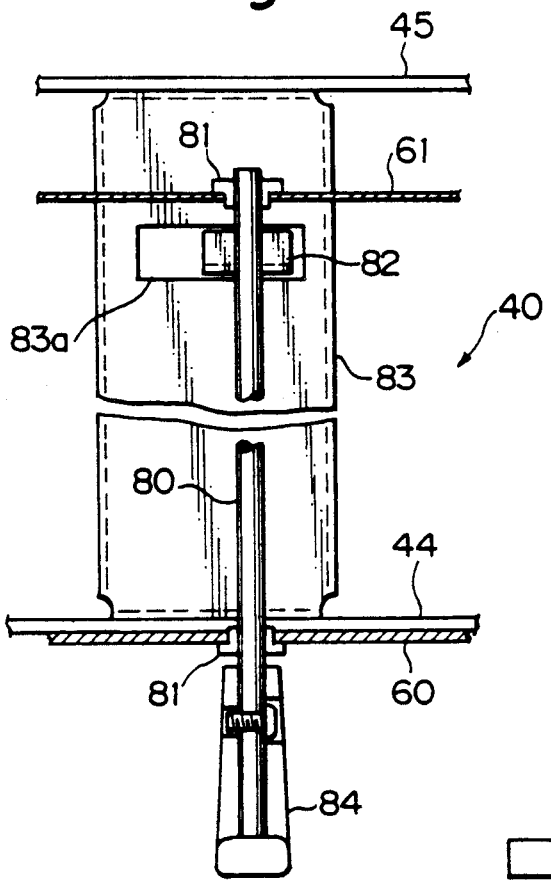
FIGS. 11, 12 and 13 are respectively a plan view, a side elevation and a front view showing a mechanism for drawing out the transport unit.
Figure 12:
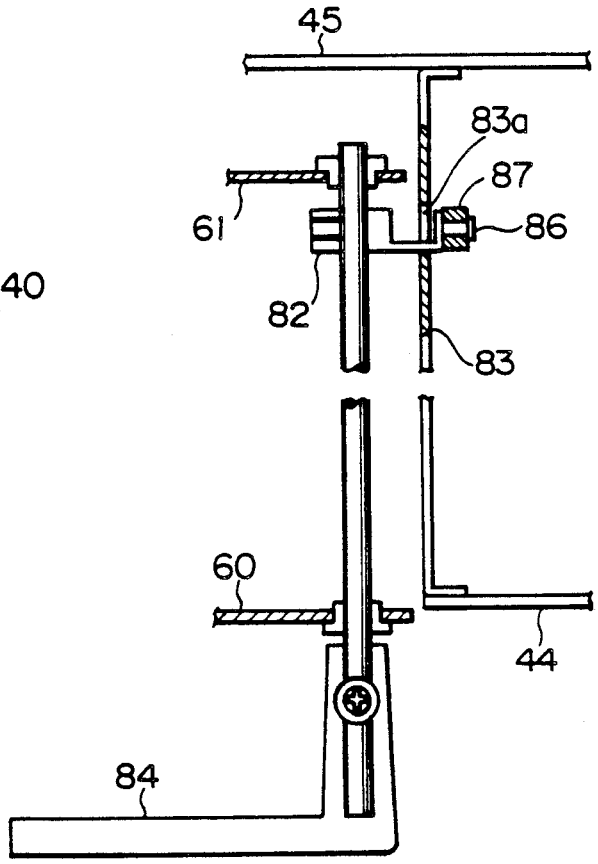
Figure 13:
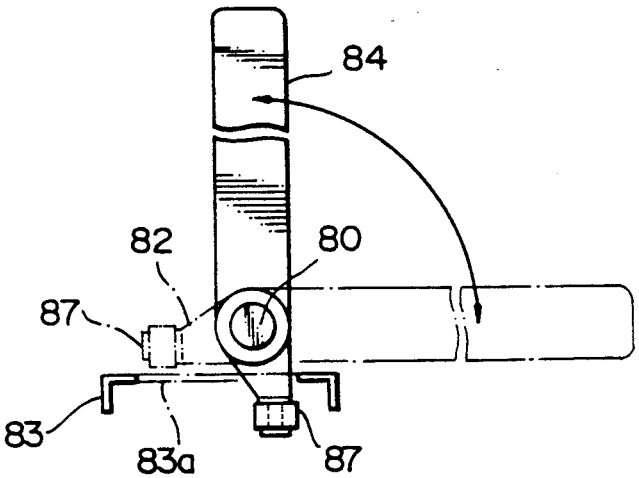

Referring to FIGS. 11 to 13, an arrangement for pulling out the transport unit 40 and how it is pulled out will be described. As shown, an operating shaft 80 is rotatably mounted on the front and rear walls 60 and 61 of the transport unit 40 by bearings 81. A stop arm 82 is affixed to the operating shaft 80. When the transport unit 40 is mounted in the copier body, the stop arm 82 mates with a rectangular hole 83*a* formed through a stay 83 which is supported by the front and rear panels 44 and 45 of the copier body, as shown in FIG. 12 (sectional side elevation of FIG. 11). A lever 84 for manipulation is mounted on the outermost end of the operating shaft 80. FIG. 13 shows the lever 84 and stop arm 82 in two different positions, i.e., a position in which the stop arm 82 is received in the hole 83*a* and a position in which the former is released from the latter (dash-and-dot lines). Specifically, when the lever 84 is held in a vertical position as shown in FIG. 13 and before it reaches a horizontal position, the transport unit 40 cannot be pulled out of the copier body. When the lever 84 is brought to the horizontal position, the stop arm 82 will be released from the hole 83*a* to allow the transport unit 40 to be pulled out. When the transport unit 40 is mounted in the copier body (FIG. 8), a reference pin 85 studded on the unit 40 mates with a reference hole which is formed through the rear panel 45 of the copier body. Likewise, another reference pin (not shown) studded on the unit 40 mates with a reference hole which is formed through the front panel 44. These pins and holes cooperate to position the transport unit 40 relative to the copier body with accuracy. Further, the entire transport unit 40 is constantly biased toward the rear panel 45 (upward as viewed in FIG. 8) by a preloading mechanism (not shown) and is thereby prevented from moving while the copier is in operation.

As shown in FIG. 13, the operating lever 84 is movable over an angle range of 90 degrees. When the lever 84 is brought to the horizontal or releasing position, the transfer belt 21 is moved away from the drums 14, as will be described in detail later. In this condition, one can pull out the transport unit 40. While the transport unit 40 is moved outward, the operating lever 84 is held in the horizontal position. At this instant, a roller 87 rotatably mounted on the stop arm 82 by a shaft 86 abuts against and rolls on the stay 83 to prevent the operating lever 84 from being moved to the vertical position. This frees the drums 14 and transfer belt 21 from damage while the transport unit 40 is moved outward. In addition, the transport unit 40 can be readily pulled out because the operating lever 84 is maintained in a substantially horizontal position.

The fixing unit 90 including the fixing roller 22 and discharging roller 23, the transfer unit including the transfer belt 21, transfer charger 17 and belt driving rollers, and the belt cleaning unit 92 for cleaning the belt 21 are so arranged on the transport unit 40 as to facilitate unit-by-unit cleaning, replacement, adjustment and other similar maintenance work (see FIG. 7).

Figure 14:
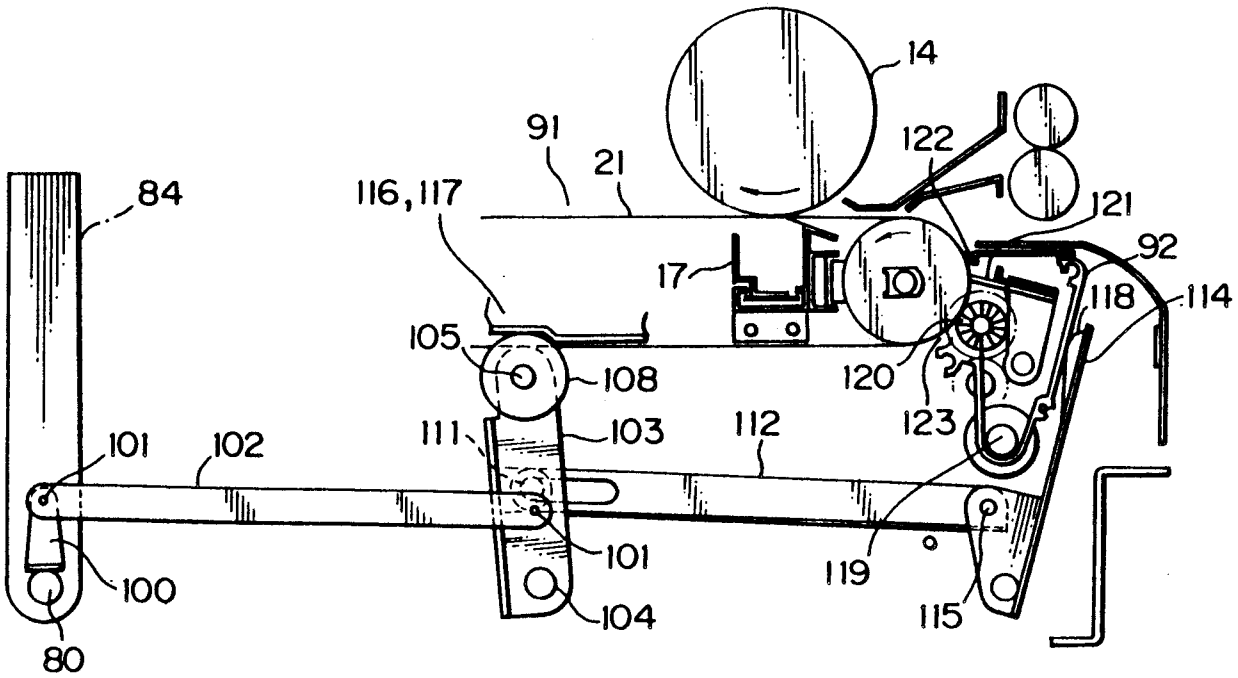
FIGS. 14 to 17 are views showing a mechanism and operation for moving a transfer belt and a photoconductive element and belt cleaning unit in the event of mounting and dismounting the transport unit.

A reference will be made to FIGS. 14 to 17 for describing how the transfer belt 21 is moved into and out of contact with the drums 14 by the operating lever 84. FIG. 14 shows the transfer belt 21 held in contact with the drums 14. Drive arms 100 are affixed to the operating shaft 80, and each is operatively connected to an arm 103 by a pin 101 and a link 102 (FIGS. 14 an 17). The arm 103 is formed by bending the front and rear ends of a relatively broad and thin plate which straddles the links 102. A pivot shaft 104 is rigidly connected to the lower end of the arm 103 and rotatably suppoted by the opposite walls 60 and 61 of the transport unit 40 by bearings (not shown). As shown in FIG. 17, rollers 108 are mounted at the other end of the bent portions of the arm 103 by a shaft 105, bearings 106 and springs 107 in such a manner as to be rotatable and movable over a predetermined range in the up-and-down direction. The links 102 are rotatably connected to the arm 103 by pins 101. The flat portion of the arm 103 has at its central portion an opening 110 and a pair of parallel lugs 109 extending from the edges of the opening 110. A shaft 111 is supported by the lugs 109 at opposite ends thereof. A link 112 is supported at one end by the shaft 111 and at the other end by a shaft 115 which extends between opposite sides of an arm 114. This arm 114 is adapted to urge the belt cleaning unit 92 against the transfer belt 21.

The movement of the transfer belt 21 toward and away from the drums 14 and the movement of the belt cleaning unit 92 toward and away from the belt 21 will be described with reference to FIG. 14. The arm 103 raises the transfer belt 21 by bent portions of opposite side walls 116 and 117 of the transfer unit through the rollers 108. Then, the transfer belt 21 is rotated about a drive roller shaft which is located at the end of the belt 21 which is not shown in the figure, until it has been stopped by a stop (not shown) mounted on the copier body. In this condition, the transfer belt 21 presses itself against the drums 1 by an adequate pressure. At the same time, a leaf spring 118 affixed to the arm 114 urges the belt cleaning unit 92 counterclockwise about a shaft 119. Hence, a brush 120, a blade 121, an outlet seal 122 and an inlet seal 123 included in the belt cleaning unit 92 are held in pressing contact with the transfer belt 21 by an adequate pressure. The position shown in FIG. 14 will be referred to a first position hereinafter. In the first position, the cleaning unit 92 removes toner particles from the transfer belt 21 and thereby maintains it clean in the image transfer station.

Figure 15:
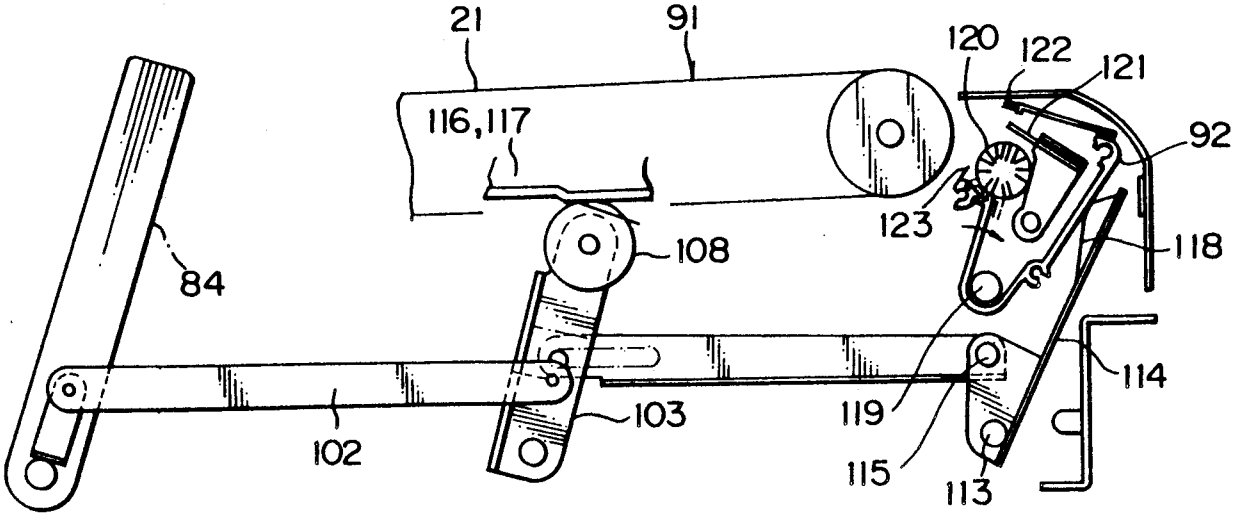

FIG. 15 shows a second position which occurs when the operating lever 84 is slightly tilted clockwise. As shown, the arm 103 interlocked with the operating lever 84 is also rotated clockwise with the result that the arm 114 and belt cleaning unit 92 are released from the transfer belt 21 due to gravity and the force of the spring 118. However, the transfer unit 91 remains in the first position due to the overlap of the arm 103. Here, the belt cleaning unit 92 is stopped by a stop (not shown).

Figure 16:
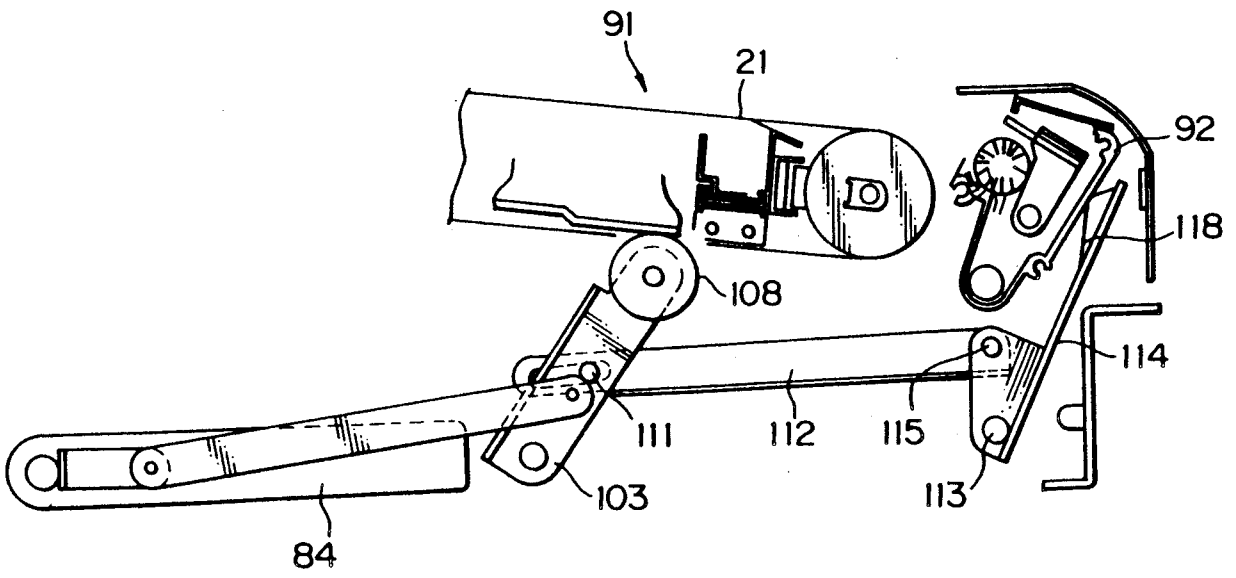
Figure 17:
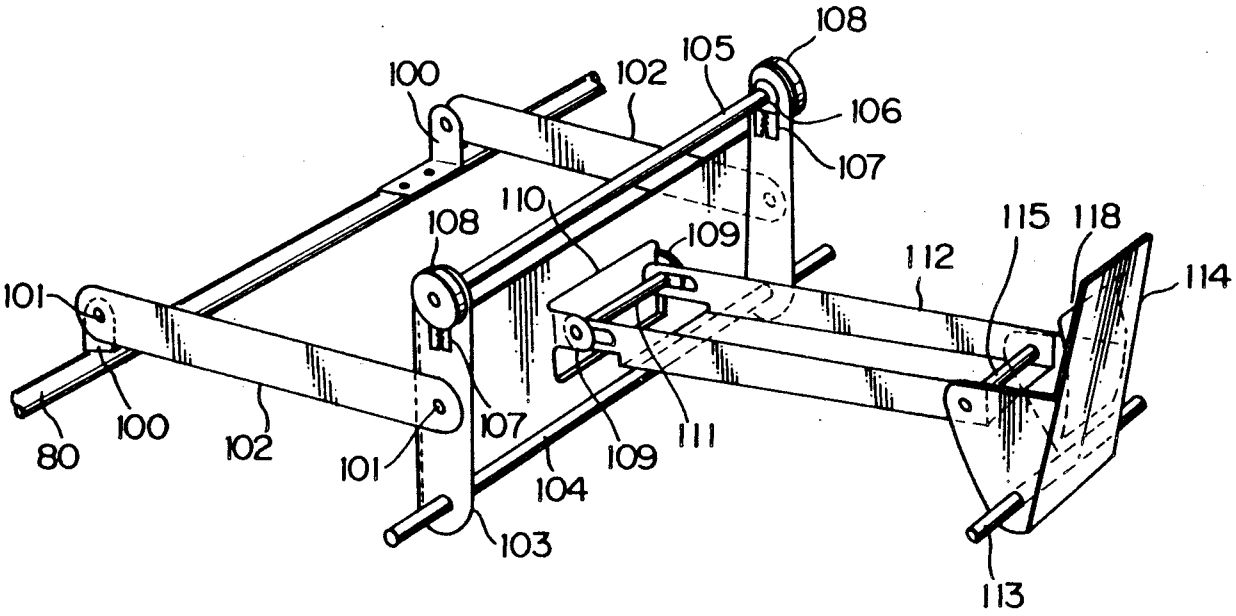
Figure 18:
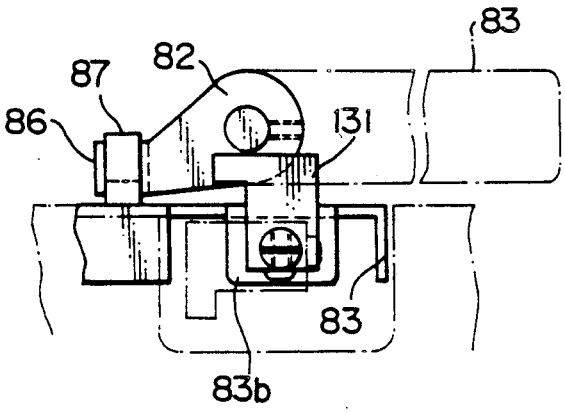
FIGS. 18 to 24 are views showing the construction and operation of a mechanism for restricting and changing the distance to which the transport unit can be pulled out.

As shown in FIG. 16, when the operating lever 84 is further rotated to the horizontal position, the shaft 111 slides in elongate slots of the link 112 to cause the transfer unit 91 to move clockwise while maintaining the belt cleaning unit 92 in the second position. This sets up a third position in which the transfer belt 21 is spaced apart from the drums 14. In this position, the stop arm 82 is released from the hole **83*a* of the stay 83 to allow the transport unit 40** to be pulled out of the copier body.

In the above condition, the transfer belt 21 can be released from the drums 14 without interfering with the belt cleaning unit 92, whereby the transfer belt 21, brush 120 and blade 121 are protected against damage. Further, the space resulting from the release of the transfer belt 21 from the drums 14 facilitates the removal of a jamming paper sheet which may exist between the sheet feeding section 19 and the transfer unit 40. When the transfer unit 91 is returned to the operative position by reversing the sequence shown in FIGS. 14, 15 and 16, the predetermined positional relationship between the belt cleaning unit 92 and the transfer belt 21 is not disturbed.

Figure 19:
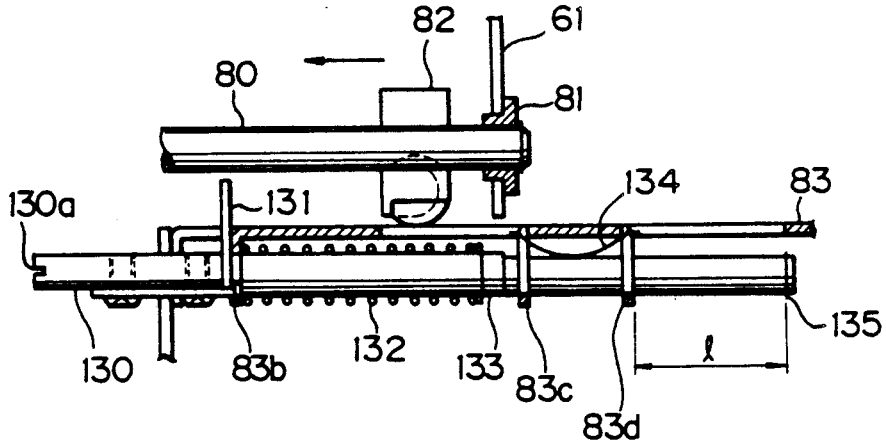
Figure 20:
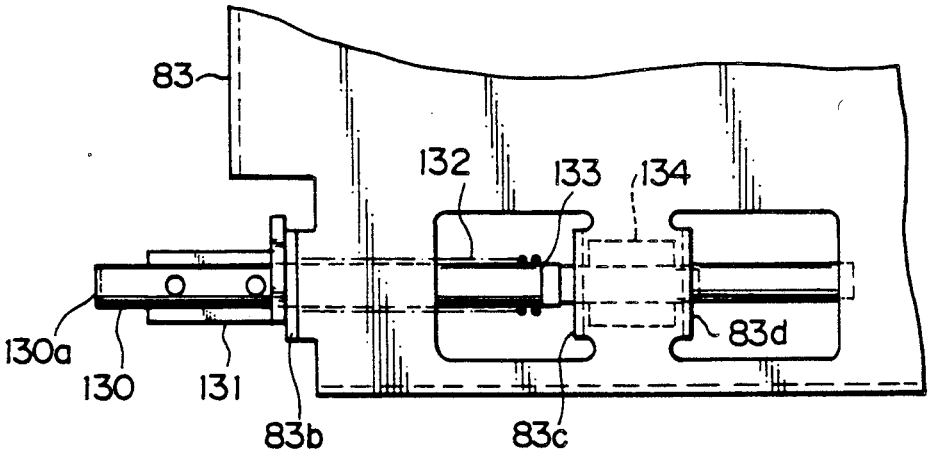
Figure 21:
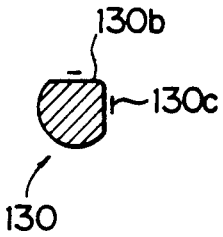
Figure 22:
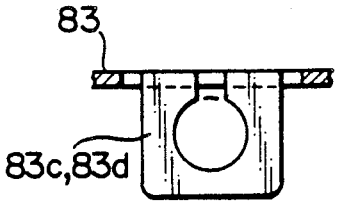
Figure 23:
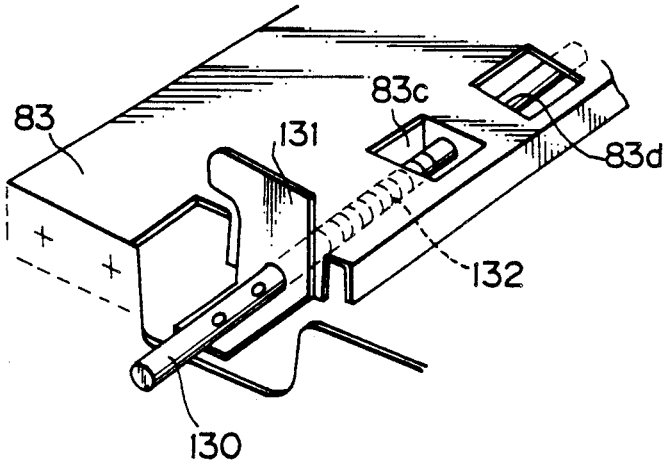
Figure 24:
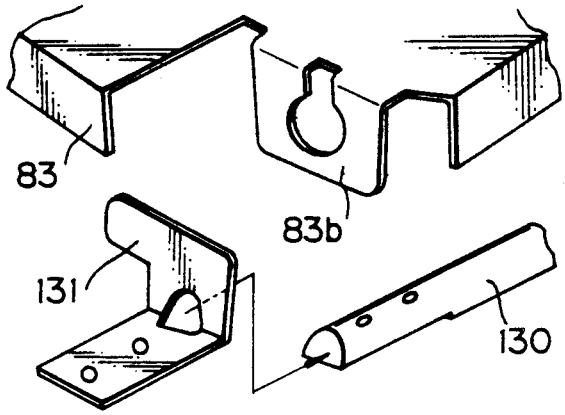

Referring to FIGS. 18 to 22, an arrangement for restricting the amount by which the transport unit 40 is to be pulled out and changing it over will be described. This arrangement is provided on the outlet side of the stay 83 shown in FIG. 11. As shown, a bent arm **83*b* extends from the outlet side of the stay 83. A slide shaft 130 is loosely received in an opening which is formed through the bent arm 83*b*. As shown in FIG. 19, the slide shaft 130 has a slot 130*a* at its left end and a stop 131 at the right of the slot 130*a*. Specifically, the stop plate 131 is fastened to the slide shaft 130 by a screw. A compression spring 132 is coupled over the slide shaft 130 at the right-hand side of the bent arm 83*b*. The other end of the spring 132 is anchored to the slide shaft 130 by an E-ring 133 at a position where an adequate pressure acts on the slide shaft 130. In this configuration, the slide shaft 130 is constantly biased by the spring 132 to the right resulting in the stop plate 131 abutting against the bent arm 83*b*. The upper wall of the stay 83 is cut and bent downward to form a pair of arms 83*c* and 83*d*, as shown in FIG. 22. The arms 83*c* and 83*d* are positioned one after the other in the front-and-rear direction and at the rear of the E-ring 133. The slide shaft 130 extends to the rear throughout loose holes which are formed through the arms 83*c* and 83*d*. An E-ring 135 is fitted on the slide shaft 130 at a distance l as measured from the arm 83*d* when the stop plate 131 is abutted against the arm 83*b*. As shown in FIG. 21, that part of the slide shaft 130 which is located at the right-hand side of the E-ring 133 has a cross-section which includes two perpendicular flat portions 130*b* and 130*c*. A leaf spring 134 interposed between the arms 83*c* and 83*d* abuts against the upper flat portion 130*b* with an adequate force which does not interfere with the sliding movement of the slide shaft 130, thereby restricting the rotation of the slide shaft 130. FIGS. 23 and 24** are respectively a perspective view and an exploded perspective view which will be useful for more clearly understanding the above-described configuration.

As one begins to pull out the transport unit 40, the stop arm 82 abuts against the stop plate 131. As the operator further pulls out the transport unit 40, the stop arm 82 pushes the stop plate 131 with the result that the slide shaft 130 is caused to slide over the distance l as shown in FIG. 19. When the E-ring 135 abuts against the arm **83*d*, any further movement of the transport unit 40 is inhibited. In ordinary operating conditions, the transport unit 40** may be pulled out to such a restricted position for removing a jamming paper sheet or cleaning various portions.

The amount by which the transport unit 40 is to be pulled out can be changed by a serviceman for the replacement of parts, cleaning of complicated portions, lubrication, etc. Specifically, when the slide shaft 130 is driven counterclockwise with a screwdriver or similar tool being mated with the slot **130*a* of the slide shaft 130, the slide shaft 130 rotates about 90 degrees while urging the leaf spring 134 upward. Consequently, the leaf spring 134 abuts against and urges the other flat surface 130*c* of the slide shaft 130. The stop plate 131 is also rotated from the position where it abuts against the stop arm 82 to a retracted position. Of course, stops (not shown) limit the angular movement of the slide shaft 130** to a range of about 90 degrees in both of the clockwise and counterclockwise directions.

In the above condition, the transport unit 40 can be pulled out by an amount which is not limited by the stop plate 131 of the slide shaft 130 and is equal to the maximum slidable distance of the slide rails 48. This allows one to readily perform inspection and maintenance on various units and parts and, if necessary, by bodily removing the fixing unit 90, transfer unit 91, etc.

In summary, it will be seen that the present invention provides an image forming apparatus in which a paper feeding section and a transport unit which defines a paper transport path other than the paper feeding section can be slid out of the apparatus body independently of each other, facilitating the removal of a jamming paper sheet and maintenance. Since the sheet feeding section is pulled out sideways from the apparatus body while the transport unit is pulled out frontward, a sorter, finisher or similar optional unit can be mounted on a paper discharging section without obstructing systematization and multi-functional setting. It is not necessary to form extremely wide openings through the front and side walls of the apparatus housing. This, coupled with the fact that structural bodies which support sliding sections for pulling out the two independent units extend perpendicularly to each other, makes up for the decrease in mechanical strength ascribable to the openings of the apparatus body.

Various modifications will become possible for those skilled in the art after receiving the teachings of the present disclosure without departing from the scope thereof.

What is claimed is:

1. An image forming apparatus using an electrophotographic process, comprising:

an image carrier;

paper feeding means provided in a paper feeding section which is located at one of laterally opposite sides of a body of said image forming apparatus and which comprises a means for holding a plurality of paper cassettes;

image transferring means provided in an image transferring section for transferring a toner image formed on said image carrier to a paper sheet which is fed from said paper feeding section;

image fixing means provided in an image fixing section for fixing the toner image transferred to the paper sheet;

paper transporting means for transporting the paper sheet fed from said paper feeding means along a paper transport path which extends to a paper discharging section via said image transferring section and said image fixing section, said image transferring means, said image fixing means and said paper transporting means constituting a transport unit;

first guide means extending in a lateral direction in said body for guiding said entire paper feeding section such that said section is slidable outward in a direction opposite to an intended direction of paper transport and inward in said intended direction of paper transport; and second guide means extending in a longitudinal direction in said body for guiding said transport unit which is slidable inward and outward perpendicularly to the intended direction of paper transport.

2. An apparatus as claimed in claim 1, further comprising a first and a second structural body for supporting respectively said first and said second guiding means, said structural bodies extending crosswise to each other.

3. An apparatus as claimed in claim 1, wherein said image forming apparatus comprises a multi-color image forming apparatus which comprises:

a plurality of photoconductive elements each constituting said image carrier;

an image transfer belt rotatable in contact with said plurality of photoconductive elements at predetermined successive image transfer positions for transporting the paper sheet; and a belt cleaning unit for cleaning said image transfer belt.

4. An apparatus as claimed in claim 3, wherein said image transfer belt and said image transferring means constitute a transfer unit, said transport unit further comprising said transfer unit and said belt cleaning unit.

5. An image forming apparatus using an electrophotographic process, comprising:

an image carrier;

paper feeding means provided in a paper feeding section which is located at one of laterally opposite sides of a body of said image forming apparatus and which comprises holding means for holding a plurality of paper cassettes;

image transferring means provided in an image transferring section for transferring a toner image formed on said image carrier to a paper sheet which is fed from said paper feeding section;

image fixing means provided in an image fixing section for fixing the toner image transferred to the paper sheet;

paper transporting means for transporting the paper sheet fed from said paper feeding means along a paper transport path which extends to a paper discharging section via said image transferring section and said image fixing section, said image transferring means, said image fixing means and said paper transporting means constituting a transport unit;

first guide means extending in a lateral direction in said body for guiding said entire paper feeding section such that said section is slidable outward in a direction opposite to an intended direction of paper transport and inward in said intended direction of paper transport, said first guide means comprising a pair of sliding sections which support said paper feeding means and which are connected to said body; and second guide means extending in a longitudinal direction in said body for guiding said transport unit which is slidable inward and outward perpendicularly to the intended direction of paper transport, said second guide means comprising a pair of sliding sections which support said transport unit and which are connected to said body.

6. An apparatus as claimed in claim 5, in which each of said sliding sections of said first guide means comprises a slide rail which is rigidly connected to said body by a bracket.

7. An apparatus as claimed in claim 6, in which each of said sliding sections of said second guide means comprises a slidable rail, a stationary rail, balls intervening between said slidable and stationary rails, slide guides fixed to said slidable rail, and a stay rigidly connected to said stationary rail.

8. An apparatus as claimed in claim 7, in which said sliding sections of said first and second guide means extend crosswise to each other at at least one location.

9. An apparatus as claimed in claim 8, in which said sliding sections of said first and second guide means, said brackets, and covers of said body form a three-dimensional framework.

* * * * *